US010092938B2

(12) United States Patent
Yamanaka et al.

(10) Patent No.: US 10,092,938 B2
(45) Date of Patent: Oct. 9, 2018

(54) PLATED STEEL PLATE FOR HOT PRESSING AND HOT PRESSING METHOD OF PLATED STEEL PLATE

(71) Applicant: NIPPON STEEL & SUMITOMO METAL CORPORATION, Tokyo (JP)

(72) Inventors: Shintaro Yamanaka, Tokyo (JP); Jun Maki, Tokyo (JP); Masao Kurosaki, Tokyo (JP); Kazuhisa Kusumi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 358 days.

(21) Appl. No.: 14/378,575

(22) PCT Filed: Feb. 8, 2013

(86) PCT No.: PCT/JP2013/053070
§ 371 (c)(1),
(2) Date: Aug. 13, 2014

(87) PCT Pub. No.: WO2013/122004
PCT Pub. Date: Aug. 22, 2013

(65) Prior Publication Data

US 2015/0020562 A1 Jan. 22, 2015

(30) Foreign Application Priority Data

Feb. 14, 2012 (JP) ..... 2012-029396

(51) Int. Cl.
*B21D 39/00* (2006.01)
*B21D 22/02* (2006.01)
(Continued)

(52) U.S. Cl.
CPC ..... *B21D 22/022* (2013.01); *C22C 38/002* (2013.01); *C22C 38/02* (2013.01);
(Continued)

(58) Field of Classification Search
None
See application file for complete search history.

(56) References Cited

U.S. PATENT DOCUMENTS 4,707,415 A 11/1987 Ikeda et al.
4,957,594 A * 9/1990 Yamazaki ..... C25D 3/22 205/177

(Continued)

FOREIGN PATENT DOCUMENTS

JP 2000-38640 A 2/2000
JP 2001-220690 A 8/2001

(Continued)

OTHER PUBLICATIONS

International Search Report, issued in PCT/JP2013/053070, dated Mar. 12, 2013.

(Continued)

*Primary Examiner* — Seth Dumbris
(74) *Attorney, Agent, or Firm* — Birch, Stewart, Kolasch & Birch, LLP

(57) ABSTRACT

The present invention provides plated steel sheet for hot press use which is excellent in hot lubricity, coating adhesion, spot weldability, and coated corrosion resistance and a method of hot pressing plated steel sheet. The present invention is Plated steel sheet for hot press use and a method of hot pressing plated steel sheet characterized by being plated steel sheet for hot press use which contains an Al plating layer which is formed on one surface or both surfaces of said steel sheet, and a surface coating layer which is formed on said Al plating layer, said surface coating layer containing at least one Zn compound which is selected from a group comprised of Zn hydroxide, Zn phosphate, and a Zn organic acid.

6 Claims, 2 Drawing Sheets

(51) Int. Cl.

| | |
|---|---|
| ***C23C 2/12*** | (2006.01) |
| ***C23C 2/40*** | (2006.01) |
| ***C22C 38/04*** | (2006.01) |
| ***C23C 2/20*** | (2006.01) |
| ***C23C 2/28*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/18*** | (2006.01) |
| ***C23C 28/00*** | (2006.01) |
| ***C23C 22/66*** | (2006.01) |
| ***C23C 22/68*** | (2006.01) |
| ***C23C 2/26*** | (2006.01) |
| *C21D 9/48* | (2006.01) |
| *C21D 1/673* | (2006.01) |

(52) U.S. Cl.

CPC ..... *C22C 38/04* (2013.01); *C22C 38/06* (2013.01); *C22C 38/12* (2013.01); *C22C 38/14* (2013.01); *C22C 38/18* (2013.01); *C23C 2/12* (2013.01); *C23C 2/20* (2013.01); *C23C 2/26* (2013.01); *C23C 2/28* (2013.01); *C23C 2/40* (2013.01); *C23C 22/66* (2013.01); *C23C 22/68* (2013.01); *C23C 28/00* (2013.01); *C23C 28/322* (2013.01); *C23C 28/34* (2013.01); *C21D 1/673* (2013.01); *C21D 9/48* (2013.01); *Y10T 428/12535* (2015.01); *Y10T 428/12556* (2015.01); *Y10T 428/12569* (2015.01); *Y10T 428/12611* (2015.01)

(56) References Cited

U.S. PATENT DOCUMENTS

| | | | | |
|---|---|---|---|---|
| 5,525,431 | A * | 6/1996 | Kanamaru | C23C 22/08 148/258 |
| 6,296,805 | B1 | 10/2001 | Laurent et al. | |
| 6,878,462 | B1 * | 4/2005 | Umino | C23C 28/023 428/141 |
| 2005/0037208 | A1 * | 2/2005 | Ogino | C23C 22/68 428/425.8 |
| 2011/0030441 | A1 | 2/2011 | Maki et al. | |
| 2012/0073351 | A1 | 3/2012 | Maki et al. | |
| 2012/0085466 | A1 | 4/2012 | Lupp et al. | |
| 2014/0048181 | A1 * | 2/2014 | Banik | C23C 28/345 148/230 |

FOREIGN PATENT DOCUMENTS

| | | | | |
|---|---|---|---|---|
| JP | 2003-129209 | A | 5/2003 | |
| JP | 2004-211151 | A | 7/2004 | |
| JP | 2005-48200 | A | 2/2005 | |
| JP | 2005-74468 | A | 3/2005 | |
| JP | 2007231375 | * | 9/2007 | C23C 2/26 |
| JP | 2007-302982 | A | 11/2007 | |
| JP | 2008-189965 | A | 8/2008 | |
| JP | 2008189965 | * | 8/2008 | C23C 26/00 |
| JP | 2008-223084 | A | 9/2008 | |
| JP | 2009-127077 | A | 6/2009 | |
| JP | 2010-37356 | A | 2/2010 | |
| JP | 2010-77498 | A | 4/2010 | |
| JP | 2011-149084 | A | 8/2011 | |
| WO | WO 2009/131233 | A1 | 10/2009 | |
| WO | WO 2010/089273 | A1 | 8/2010 | |
| WO | WO2012120081 | * | 9/2012 | C23C 2/26 |

OTHER PUBLICATIONS

AK Steel; "Aluminized Type 1 Steels"; dated Apr. 20, 2000.

AK Steel; "Ultralume(TM): Aluminized Type 1 Heat-Treatable Boron Steel", dated Jul. 11, 2011.

* cited by examiner

PLATED STEEL PLATE FOR HOT PRESSING AND HOT PRESSING METHOD OF PLATED STEEL PLATE

TECHNICAL FIELD

The present invention relates to plated steel sheet for hot press use which is coated by an Al plating which is mainly comprised of Al and which is excellent in hot lubricity, coating adhesion, spot weldability, and coated corrosion resistance and a method of hot pressing such plated steel sheet.

BACKGROUND ART

In recent years, to protect the environment and prevent global warming, demand has been rising for keeping down the consumption of fossil fuels. This demand has had an impact on various manufacturing industries. For example, even for automobiles, which are essential means of transport for daily life and activities, are no exceptions. Improvement of fuel economy etc. by lightening of the weight of the chasses are being sought. However, in automobiles, just realizing lighter weight of a chassis is not allowed in terms of product performance. It is necessary to secure suitable safety.

Much of the structure of an automobile is formed by an iron-based material, in particular steel sheet. Reduction of the weight of this steel sheet is important in lightening the weight of the chassis. However, as explained above, just reducing the weight of the steel sheet is not allowed. Securing mechanical strength of the steel sheet is simultaneously sought. Similar demands are made on steel sheet in various other manufacturing industries in addition to the automobile manufacturing industry. Accordingly, steel sheet which is raised in mechanical strength so as to enable the thickness to be reduced compared with the conventionally used steel sheet while maintaining or improving the mechanical strength is being researched and developed.

In general, a material which has a high mechanical strength tends to fall in shape freezability after bending or other shaping and is difficult to form into a complicated shape. As one means for solving this problem with shapeability, the so-called "hot press method (also called the hot stamp method, hot pressing method, or the die quench method)" may be mentioned. With this hot press method, the material to be shaped is heated once to a high temperature to soften the steel sheet by heating, then the steel sheet is press formed to shape it, then is cooled. According to this hot press method, the material is heated once to a high temperature to make it soften, so the material can be easily press formed. Furthermore, due to the hardening effect caused by the cooling after shaping, the material can be raised in mechanical strength. Therefore, the hot press method enables a shaped product to be obtained which achieves both good shape freezability and high mechanical strength.

However, if applying this hot press method to steel sheet, heating the steel sheet to an 800° C. or more high temperature causes the surface of the steel sheet to oxidize and scale (oxides) to form. Therefore, after performing hot press forming, a step of removing this scale (descaling step) becomes necessary and the productivity falls. Further, in members which require corrosion resistance etc., the surfaces of the members have to be treated to make them rustproof or covered by metal after being worked. A surface cleaning step and surface treatment step become necessary, so the productivity further falls.

As a method for suppressing such a drop in productivity, the method of providing the steel sheet with a covering may be mentioned. As the covering of the steel sheet, in general an organic material or inorganic material or other various materials are used. Among these, galvannealed steel sheet, which has a sacrificial corrosion action against the steel sheet, is being widely used for automobile steel sheet etc. from the viewpoint of the anticorrosion performance and steel sheet production technology. However, the heating temperature (700 to 1000° C.) in hot press forming is higher than the decomposition temperature of the organic material or the melting point and boiling point of the Zn or other metal. When using a hot press for heating, the surface coating and plating layer evaporate causing remarkable deterioration of the surface properties.

Therefore, as the steel sheet to which the hot press method which is accompanied with high temperature heating is applied, it is desirable to use steel sheet which is provided with an Al-based metal covering, which has a higher boiling point than an organic material covering or a Zn-based metal covering, or an Al plated steel sheet. Here, an "Al plated steel sheet" includes sheets to which elements other than Al have been added to improve the characteristics of the plating layer. The Al of the plating layer should be, by mass %, 50% or more.

By providing the Al-based metal covering, it is possible to prevent scale from forming on the surface of the steel sheet and therefore descaling and other steps become unnecessary, so the shaped product is improved in productivity. Further, an Al-based metal covering also has a rustproofing effect, so the corrosion resistance is also improved. The method of hot pressing steel sheet which comprises steel sheet which has a predetermined chemical composition and is provided with an Al-based metal covering is disclosed in PLT 1.

However, when providing an Al-based metal covering, depending on the conditions of the preheating before the hot press forming, the Al covering will melt, then Fe will diffuse from the steel sheet and cause the formation of an Al—Fe alloy layer and, further, growth of the Al—Fe alloy layer until the surface of the steel sheet becomes an Al—Fe alloy layer. This Al—Fe alloy layer is extremely hard, so there was the problem that contact with the die at the time of press forming caused work marks on the shaped product.

An Al—Fe alloy layer is lower in slip at its surface and is poorer in lubricity. Furthermore, this Al—Fe alloy layer is hard and easily fractures. The plating layer suffers from cracks and powdering etc., so the shapeability falls. Further, any peeled off Al—Fe alloy layer sticks to the die or the surface of Al—Fe alloy layer of the steel sheet, is strongly rubbed against, and sticks to the die or Al—Fe intermetallic compounds derived from the Al—Fe alloy layer to adhere to the die and cause the shaped product to decline in quality. For this reason, it is necessary to periodically remove the Al—Fe intermetallic compounds which have adhered to the die. This becomes one cause of a drop in productivity of the shaped product or an increase in the production costs.

Furthermore, an Al—Fe alloy layer is low in reactivity with the usual phosphate treatment. Therefore, the surface of the Al—Fe alloy layer cannot be formed with a chemically converted coating (phosphate coating) as pretreatment for electrodeposition painting. Even when a chemically converted coating is not formed, if making the material good in coating adhesion then making the amount of deposition of Al sufficient, the coated corrosion resistance also will become excellent, but if increasing the amount of deposition of Al, adhesion of Al—Fe intermetallic compounds to the die will increase.

Adhesion of Al—Fe intermetallic compounds include the case where peeled off parts of the Al—Fe alloy layer deposit and the case where the Al—Fe alloy layer surface is strongly rubbed against and deposits. When hot press forming steel sheet which has a surface coating, if improving the lubricity, the strong rubbing and adhesion by the surface of the Al—Fe alloy layer are eased. However, improvement of the lubricity is not effective for alleviating the deposition of peeled off parts of the Al—Fe alloy layer on the die. To alleviate the deposition of peeled off parts of the Al—Fe alloy layer on the die, it is most effective to reduce the amount of deposition of Al on the Al plating. However, if reducing the amount of deposition of Al, the corrosion resistance deteriorates.

Therefore, steel sheet which prevents the shaped product from being formed with work marks is disclosed in PLT 2. The steel sheet which is disclosed in PLT 2 is steel sheet which has a predetermined chemical composition on the surface of which an Al-based metal covering is provided and, furthermore, on the surface of that Al-based metal covering an inorganic compound coating, organic compound coating, or composite compound coating of the same which contains at least one of Si, Zr, Ti, or P is formed. In the steel sheet which is formed with such a surface coating like that disclosed in PLT 2, even at the time of the press forming after heating, the surface coating will never peel off and therefore it is possible to prevent the formation of work marks at the time of press forming. However, with the surface coating which is described in PLT 2, a sufficient lubricity cannot be obtained at the time of press forming, so improvement etc. in the lubricant are sought.

PLT 3 discloses a method of solving the problem of surface deterioration of galvanized steel sheet due to evaporation of the galvanization layer in hot pressing of galvanized steel sheet. That is, it causes the formation of a high melting point zinc oxide (ZnO) layer as a barrier layer on the surface of the galvanization layer to thereby prevent the evaporation of Zn in the Zn plating layer at the bottom layer. However, the method which is disclosed in PLT 3 is predicated on the steel sheet having a galvanization layer. The Al content in the galvanization layer is allowed to be up to 0.4%. However, the content of Al is desirably small. The method which is disclosed in. PLT 3 is for preventing evaporation of Zn from the Zn plating layer. Al is included only incidentally. However, with incidental inclusion of Al in the Zn plating layer, it is not possible to completely prevent the evaporation of Zn in the Zn plating layer. Therefore, the general practice is to use Al plated steel sheet which has high boiling point Al as a main component.

PLT 4 discloses a method of applying a wurtzite type compound to the surface of an Al plated steel sheet. The method which is disclosed in PLT 4 improves the hot lubricity and the chemical convertability and secures adhesion of the surface coating before hot press forming by adding a binder ingredient to the surface coating. However, the binder of the method which is disclosed in PLT 4 ends up breaking down due to heat at the time of hot press forming and therefore there was the problem that the wurtzite type compound fell in coating adhesion from the steel sheet at the time of shaping.

PLT 5 discloses galvannealed steel sheet which is formed with a surface coating layer which contains Zn hydroxide and Zn sulfate. However, the steel sheet which is disclosed in PLT 5 forms a surface coating layer on the galvannealed steel sheet, so while it is excellent in corrosion resistance, there was the problem that the zinc in the galvannealed layer ended up evaporating at the time of hot pressing. Further, both surfaces of the steel sheet which is disclosed in PLT 5 are formed with an oxide layer which has $3Zn(OH)_2.ZnSO_4.nH_2O$ (n=0 to 5). $ZnSO_4$ dissolves the Al plating layer, so an Al plated steel sheet could not be used.

PLT 6 discloses steel sheet which is comprised of an Al plated steel sheet which is formed with a surface coating layer which contains a Zn compound which is selected from Zn sulfate, Zn nitrate, and Zn chloride. However, an aqueous solution of Zn sulfate, Zn nitrate, or Zn chloride is high in pH, so when coating the treatment solution when forming the surface coating layer, acts to dissolve the Al plated steel sheet. As a result, there was the problem that the coated corrosion resistance was degraded. Further, while the cause is not certain, there was the problem that the weldability was also degraded. This problem was particularly remarkable when including Zn sulfate and Zn nitrate as the Zn compound.

PLT 7 discloses steel sheet which is comprised of an Al plated steel sheet which is formed with a surface coating layer which contains a vanadium compound, a phosphoric acid compound, and at least one type of metal compound which is selected from Al, Mg, and Zn. However, the surface coating layer of the steel sheet which is disclosed in PLT 7 contains a vanadium compound, so the valence of the vanadium compound causes various colors to be formed and therefore there was the problem of an uneven appearance.

CITATIONS LIST

Patent Literature

PLT 1: Japanese Patent Publication No. 2000-38640A
PLT 2: Japanese Patent Publication No. 2004-211151A
PLT 3: Japanese Patent Publication No. 2003-129209A
PLT 4: WO2009/131233A
PLT 5: Japanese Patent Publication No. 2010-077498A
PLT 6: Japanese Patent Publication No. 2007-302982A
PLT 7: Japanese Patent Publication No. 2005-048200A

SUMMARY OF INVENTION

Technical Problem

Al has a high boiling point and a high melting point, so Al plated steel sheet is considered promising as steel sheet which is used for a member for which corrosion resistance is demanded such as automobile steel sheet. Therefore, various proposals have been made regarding application of Al plated steel sheet to hot pressing. However, an Al—Fe alloy layer cannot give a good lubricity in hot pressing and the press formability is inferior etc., so when using hot pressing to obtain a complicated shape of a shaped product, an Al plated steel sheet is not being used. Further, in recent years, for automobile use, steel sheet is mostly being coated after being shaped. Al plated steel sheet is further being required to offer chemical convertability (coatability) after hot press forming and coated corrosion resistance. Further, steel sheet which is used for the chasses of automobiles is also being required to have spot weldability.

The present invention was made in consideration of the above situation. The object of the present invention is to provide Al plated steel sheet for hot press use which is excellent in hot lubricity, coating adhesion, spot weldability, and coated corrosion resistance and a method of hot pressing Al plated steel sheet.

Solution to Problem

To solve the above problem, the inventors etc. engaged in intensive studies and as a result discovered that by forming a surface coating layer which contains a compound which contains Zn on the Al plating layer which is formed on one or both surfaces of steel sheet, the lubricity at the time of hot press forming becomes better and the chemical convertability also is greatly improved. Further, they discovered that by not including a vanadium compound in the surface coated layer, it is possible to prevent the valence of the vanadium compound from causing various colors to be formed and possible to solve the problem of the uneven appearance of the steel sheet. Further, they discovered that if including a predetermined amount of a Zn compound with a high water solubility such as Zn sulfate or Zn nitrate, the deposition ability at the time of application and the coating adhesion and spot weldability become inferior. Based on these discoveries, the inventors etc. completed the present invention. The gist of the present invention is follows.

(1) Plated steel sheet for hot press use characterized by being plated steel sheet for hot press use which contains steel sheet, an Al plating layer which is formed on one surface or both surfaces of the steel sheet, and a surface coating layer which is formed on the Al plating layer, the surface coating layer containing at least one Zn compound which is selected from a group comprised of Zn hydroxide, Zn phosphate, and a Zn organic acid.

(2) The plated steel sheet for hot press use according to (1) characterized in that the amount of deposition of a Zn compound in the surface coating layer is 0.5 to 7 g/m$^2$ per surface as Zn.

(3) The plated steel sheet for hot press use according to (2) characterized in that the surface coating contains, in addition to the Zn compound, at least one of a resin ingredient, silane coupling agent, or silica in a combined 5 to 30% by mass ratio with respect to the total amount of the Zn compound.

(4) The plated steel sheet for hot press use according to any one of (1) to (3) characterized in that the Al plating layer contains Si: 3 to 15%.

(5) The plated steel sheet for hot press use according to any one of (1) to (3) characterized by allowing, as the content of the Zn compound, inclusion of one or both of Zn sulfate and Zn nitrate, in mass % of respectively 10% or less.

(6) The plated steel sheet for hot press use according to (4) characterized by allowing, as the content of the Zn compound, inclusion of one or both of Zn sulfate and Zn nitrate, in mass % of respectively 10% or less.

(7) A method of hot pressing plated steel sheet characterized by blanking plated steel sheet which contains an Al plating layer which is formed on one surface of said steel sheet or both surfaces of said steel sheet and said surface coating layer which is formed on the Al plating layer and which contains at least one Zn compound which is selected from the group comprising Zn hydroxide, Zn phosphate, and a Zn organic acid, then heating and pressing the heated plated steel sheet.

(8) The method of hot pressing plated steel sheet according to (7) characterized in that in the heating before pressing, the average temperature elevation rate is 10 to 300° C./sec at the time when the plated steel sheet is heated by ohmic heating or induction heating from 50° C. to a temperature 10° C. lower than the maximum peak temperature.

Advantageous Effects of Invention

According to the present invention, it is possible to provide plated steel sheet for hot press use which is excellent in hot lubricity, coating adhesion, spot weldability, and coated corrosion resistance and a hot press method and to improve the productivity in the hot press step.

DESCRIPTION OF EMBODIMENTS

Figure 1:
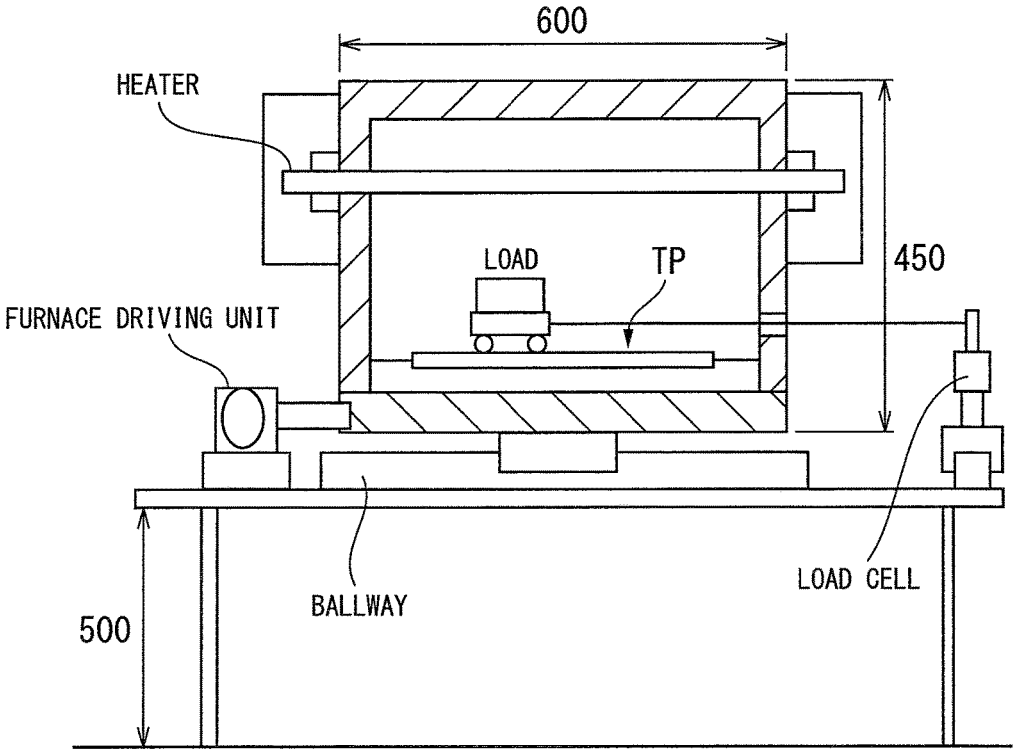
FIG. 1 is an explanatory view which explains an apparatus for evaluating the hot lubricity of the steel sheet for hot press use of the present invention.

Next, the present invention will be explained in detail.

Plated Steel Sheet for Hot Press Use

First, the plated steel sheet for hot press use of the present invention will be explained. The steel sheet for hot press use of the present invention is comprised of steel sheet on one or both surfaces of which an Al plating layer is formed and on the surface of which Al plating layer a surface coating layer which contains a compound of Zn is further formed.

Steel Sheet Before Plating

As the steel sheet before plating, steel sheet which has a high mechanical strength (meaning tensile strength, yield point, elongation, drawability, hardness, impact value, fatigue strength, creep strength, and other properties relating to mechanical deformation and fracture) is desirably used. One example of the steel sheet before plating which is used for the steel sheet for hot press use of the present invention is shown next.

First, the chemical composition will be explained. Note that, the symbols "%" mean mass % unless otherwise indicated. The chemical composition of the steel sheet before plating preferably contains, by mass %, C: 0.1 to 0.4%, Si: 0.01 to 0.6%, and Mn: 0.5 to 3%. Furthermore, it preferably contains at least one of Cr: 0.05 to 3.0, V: 0.01 to 1.0%, Mo: 0.01 to 0.3%, Ti: 0.01 to 0.1%, and B: 0.0001 to 0.1%. Further, the balance is comprised of Fe and unavoidable impurities.

C is included to secure the desired mechanical strength. If C is less than 0.1%, a sufficient mechanical strength cannot be obtained. On the other hand, if C exceeds 0.4%, the steel sheet can be hardened, but melt fracture easily occurs. Therefore, the content of C is preferably 0.1 to 0.4%.

Si is an element which improves the mechanical strength. Like C, it is included to secure the desired mechanical strength. If Si is less than 0.01%, the effect of improvement of strength is difficult to secure and a sufficient improvement in mechanical strength cannot be obtained. On the other hand, Si is an easily oxidizable element. Accordingly, if Si exceeds 0.6%, when performing hot dip Al coating, the wettability falls and nonplated parts are liable to be formed. Therefore, the content of Si is preferably made 0.01 to 0.6%.

Mn is an element which improves the mechanical strength and is also an element which improves the hardenability. Furthermore, Mn is effective for preventing hot embrittlement due to the unavoidable impurity S. If Mn is less than 0.5%, these effects cannot be obtained. On the other hand, if Mn exceeds 3%, the residual γ-phases become too great and the strength is liable to fall. Therefore, the content of Mn is preferably 0.5 to 3%.

Cr, V, and Mo are elements which improve the mechanical properties and are also elements which suppress the formation of pearlite at the time of cooling from the annealing temperature. These effects cannot be obtained if Cr is less than 0.05%, V is less than 0.01%, or Mo is less than 0.01%.

On the other hand, if exceeding Cr: 3.0%, V: 1.0%, or Mo: 0.3%, the surface area rate of the hard phases becomes excessive and the shapeability deteriorates.

Ti is an element which improves the mechanical strength and is an element which improves the heat resistance of the Al plating layer. When Ti is less than 0.01%, the effect of improvement of the mechanical strength and oxidation resistance cannot be obtained. On the other hand, if excessively including Ti, carbides and nitrides are formed and the steel is liable to be softened. In particular, when Ti exceeds 0.1%, the desired mechanical strength cannot be obtained. Therefore, the content of Ti is preferably made 0.01 to 0.1%.

B is an element which acts to improve the strength at the time of hardening. If B is less than 0.0001%, such an effect of improvement of strength cannot be obtained. On the other hand, if B exceeds 0.1%, inclusions are formed in the steel sheet causing embrittlement and the fatigue strength is liable to be lowered. Therefore, the content of B is preferably made 0.0001 to 0.1%.

Note that, the above-mentioned chemical composition of the steel sheet before plating is an example. Other chemical compositions are also possible. For example, as a deoxidizing element, Al: 0.001 to 0.08% may also be contained. Further, impurities which end up unavoidably entering in the manufacturing process etc. may also be included.

The steel sheet before plating which has such a chemical composition may be hardened by heating by the hot press method etc. even after plating so as to be given an approximately 1500 MPa or more tensile strength. Even steel sheet which has such a high tensile strength can be easily shaped by the hot press method in the state softened by heating. Further, the shaped product can realize high mechanical strength and, even when made thin for lightening the weight, can be maintained or be improved in mechanical strength.

Al Plating Layer

An Al plating layer is formed on one or both surfaces of the steel sheet before plating. The Al plating layer is, for example, formed on one or both surfaces of the steel sheet by the hot dip method, but the invention is not limited to this.

Further, the chemical composition of the Al plating layer should contain Al: 50% or more. The elements other than Al are not particularly limited, but Si may be proactively included for the following reasons.

If Si is included, an Al—Fe—Si alloy layer is formed at the interface between the plating and the base iron and therefore it is possible to suppress the formation of the brittle Al—Fe alloy layer which is formed at the time of hot dip coating. If Si is less than 3%, the Al—Fe alloy layer will grow thick at the stage of performing Al plating, cracking of the plating layer will be assisted at the time of working, and the corrosion resistance may be detrimentally affected. On the other hand, if Si exceeds 15%, conversely the volume rate of the layer which contains Si will increase and the workability of the plating layer or corrosion resistance is liable to fall. Therefore, the Si content in the Al plating layer is preferably made 3 to 15%.

The Al plating layer prevents corrosion of the steel sheet for hot press use of the present invention. Further, when working the steel sheet for hot press use of the present invention by the hot press method, even if heated to a high temperature, the surface will never oxidize and scale (oxides of iron) will never be formed. By using the Al plating layer to prevent the formation of scale, it is possible to eliminate the step of removal of scale, the step of cleaning the surface, the step of treating the surface, etc. and possible to improve the productivity of the shaped product. Further, the Al plating layer is higher in boiling point and melting point than a plating covering comprised of an organic material or a plating covering comprised of another metal-based material (for example, Zn-based material). Therefore, when using the hot press method to shape it, the covering will not evaporate, so shaping at a high temperature becomes possible, the shapeability in hot press forming is further raised, and easy shaping becomes possible.

The heating at the time of hot dip coating and hot pressing can cause the Al plating layer to alloy with the Fe in the steel sheet. Accordingly, the Al plating layer is not necessarily formed in a single layer with a constant chemical composition and will include partially alloyed layers (alloy layers).

Surface Coating Layer

The surface coating layer is formed on the surface of the Al plating layer. The surface coating layer includes one or more Zn compounds which are selected from the group comprised of Zn hydroxide, Zn phosphate, and Zn organic acid. As the Zn compound, Zn hydroxide and Zn phosphate are particularly preferred. As the Zn organic acid, Zn acetate, Zn citrate, Zn oxalate, Zn oleate, and other such Zn salts of carboxylic acids and Zn salts of hydroxyl acids, zinc gluconate, etc. may be mentioned. These compounds have the effect of improving the lubricity at the hot press or reactivity with the chemical conversion solution. Zn hydroxide and Zn phosphate have a small solubility in water, so are used as suspensions, while Zn acetate, which has a large solubility in water, is preferably used as an aqueous solution. Note that, these Zn compounds may contain one or both of Zn sulfate and Zn nitrate, but if exceeding a mass % of 10%, as explained above, the coated corrosion resistance and the weldability are degraded. Therefore, the allowable values of the contents of Zn sulfate and Zn nitrate are preferably 10% or less.

Next, the case where Zn hydroxide is contained in the surface coating layer will be used as an example for the explanation. Zn hydroxide breaks down upon heating to form a smooth coating and results in a better coated corrosion resistance than even with the case of use of ZnO. Note that, even when using a Zn compound other than Zn hydroxide, a surface coating layer is formed in the same way as the case of Zn hydroxide and a similar effect can be obtained.

The surface coating layer which contains Zn hydroxide can be formed, for example, by applying a coating which contains Zn hydroxide and by baking and drying it to harden it after application so as to thereby form a coating film on the Al plating layer. As the method of applying the Zn hydroxide, for example, the method of mixing a suspension which contains Zn hydroxide and a predetermined organic binder and applying it to the surface of the Al plating layer and the method of coating by powder coating etc. may be mentioned. As the predetermined organic binder, for example, a polyurethane-based resin, polyester-based resin, acryl-based resin, silane coupling agent, silica, etc. may be mentioned. These organic binders are made water soluble so as to enable mixing with the suspension of Zn hydroxide. The thus obtained treatment solution is coated on the surface of the Al plated steel sheet.

The Zn hydroxide is not particularly limited in particle size, but is desirably a size of 50 to 1000 nm or so. The particle size of the Zn hydroxide is made the particle size after heat treatment. That is, the particle size after holding at 900° C. in the furnace for 5 to 6 minutes, then rapid cooling in the die is made the one determined by observation by a scan type electron microscope (SEM) etc.

The contents of the resin ingredient, silane coupling agent, silica, and other binder ingredients in the surface coating are preferably, by mass ratio to the Zn hydroxide, together 5 to 30% or so. If the contents of the binder ingredients is less than 5%, the deposition effect is not sufficiently obtained and the coating easily peels off. To stably obtain the deposition effect, the binder ingredient is more preferably made, by mass ratio, 10% or more. On the other hand, even if the content of the binder ingredient exceeds 30%, the effect of deposition becomes saturated and the odor which is produced at the time of heating becomes remarkable, so this is not preferable. The upper limit of the content of the binder ingredient is more preferably made 16%.

The surface coating layer which contains the Zn compound of the present invention is confirmed to have a higher lubricity compared with even the inorganic compound coating, organic compound coating, or composite compound coating which contain at least one of Si, Zr, Ti, and P which are described in PLT 2. For this reason, the shapeability is further improved.

Figure 2:
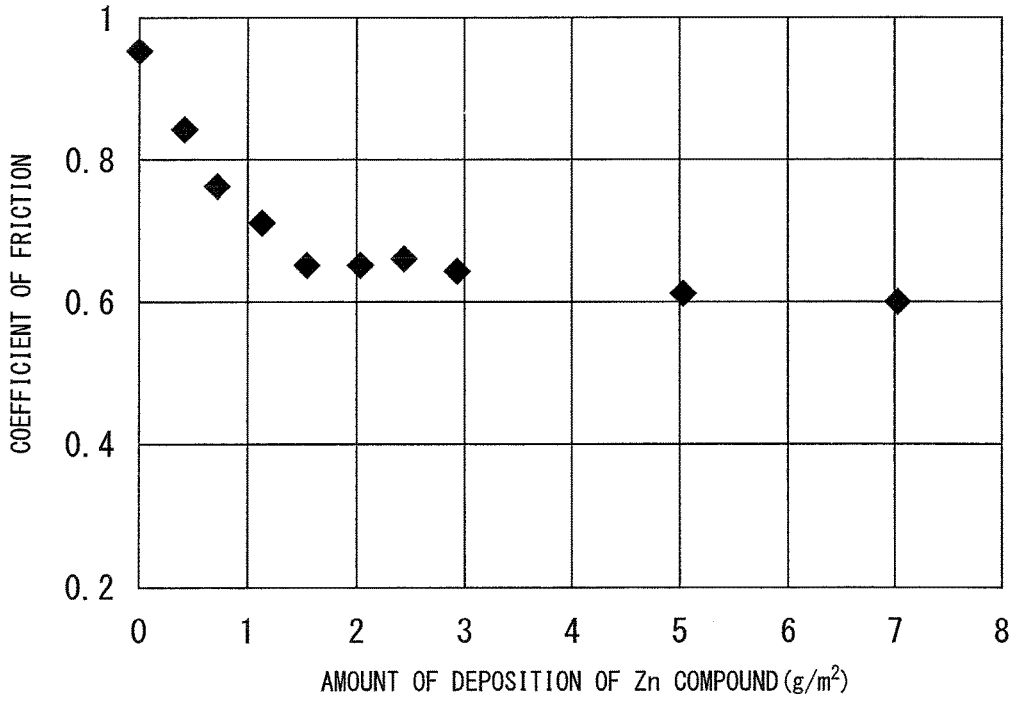
FIG. 2 is an explanatory view which explains the hot lubricity of the steel sheet for hot press use of the present invention.

The amount of deposition of Zn hydroxide at the surface coating layer which is formed on the Al plated steel sheet is preferably 0.5 to 7 g/m$^2$ per surface converted to amount of Zn. If the amount of deposition of Zn hydroxide is 0.5 g/m$^2$ or more as Zn, as shown in FIG. 2, the lubricity is improved. 1.5 g/m$^2$ or more is more preferable. On the other hand, if the amount of deposition of Zn hydroxide is over 7 g/m$^2$ as Zn, the Al plating layer and surface coating layer become too thick and the weldability and paint adhesion fall. Therefore, Zn hydroxide is preferably deposited at the surface coating layer in an amount of 0.5 to 7 g/m$^2$ as Zn per surface. Furthermore, if considering also the weldability and paint adhesion, the amount of deposition of Zn hydroxide is particularly preferably 0.5 to 2 g/m$^2$.

Note that, as the method of measurement of the amount of deposition of Zn hydroxide, for example, the fluorescent X-ray method can be utilized. The fluorescent X-ray method uses several types of standard samples with known amounts of deposition of Zn hydroxide so as to prepare a calibration line and converts the Zn intensity of the sample being measured to the amount of deposition of Zn hydroxide.

As the method of baking and drying after applying the treatment solution, for example, the method of using a using a hot air furnace, induction heating furnace, infrared ray furnace, etc. is possible. Further, a method using a combination of these is also possible. At this time, depending on the type of the binder which is included in the treatment solution, instead of baking and drying after application, for example, curing by ultraviolet rays, electron beams, etc. is also possible. As the organic binder, polyurethane or polyester or else acryl or a silane coupling agent etc. may be mentioned. However, the method of forming the surface coating layer of Zn hydroxide is not limited to these examples. Various methods may be used to form the layer.

Note that, when not using a binder, after the treatment solution is applied to the Al plating layer, the surface coating layer is somewhat low in adhesion before curing treatment. If rubbed by a strong force, it may partially peel off.

If the surface coating layer is heated once at the time of hot press forming, it exhibits extremely strong adhesion. PLT 4 discloses to improve the adhesion before hot press forming, but the present invention improves the adhesion after hot press forming. Improvement of adhesion after hot press forming cannot be obtained if including the wurtzite type compound which is disclosed in PLT 4 in the surface coating and is an important characteristic of the present invention. Due to the Zn hydroxide being heated, it is expected that it will be dehydrogenated and partially become Zn oxide etc. and the crystal structure will change. At this time, it is believed that fine particles easily proceed to sinter. In the same way, Zn phosphate and Zn organic acid also are believed to break down upon being heated. A compound with a low solubility in water such as Zn hydroxide and Zn phosphate can be applied to an Al plated steel sheet in a solution state. Further, Zn hydroxide, Zn phosphate, and Zn organic acid are believed to precipitate as compounds in the baking step after application or the heating step at the time of hot stamping, but compared with a solution dispersed in water, there is no secondary aggregation in water and precipitation occurs in a finer form. Therefore, it is believed that the precipitated particles sinter and therefore the strength as a coating can be easily maintained.

The surface coating layer improves the lubricity, so even with an Al plated steel sheet which is inferior in shapeability, the shapeability at the time of hot press forming can be improved. Further, it is possible to enjoy the excellent corrosion resistance of the Al plated steel sheet. Further, the excellent lubricity of the surface coating layer suppresses the adhesion of the Al—Fe intermetallic compounds on the die. Even if the Al plating layer powderizes, the surface coating layer which contains the Zn compound can prevent the powder (powder of Al—Fe intermetallic compound) from adhering to the die which is used for the later hot press forming. Accordingly, a step of removing the powder of the Al—Fe intermetallic compound which adheres to the die etc. become unnecessary, so the productivity of the shaped product can be further improved.

Further, the surface coating layer can play the role of a protective layer which protects damage to the Al plating layer which can occur at the time of hot press forming and can improve the shapeability. Furthermore, the surface coating layer does not lower the spot weldability and coating adhesion or other aspects of performance either. If the treatment solution when forming the surface coating layer in high in water solubility, the spot weldability and coating adhesion deteriorate. If the treatment solution is high in water solubility, the applied treatment solution easily runs off from the steel sheet and the deposition ability deteriorates.

Furthermore, the surface coating layer can greatly improve the coated corrosion resistance and can reduce the amount of deposition of Al of the Al plating layer compared with the past. As a result, even when rapidly performing hot press forming, adhesion can be reduced and the productivity of the shaped product is further raised.

Hot Press Method

Next, the method of hot pressing the steel sheet for hot press use of the present invention will be explained.

In the hot press method of the present invention, first, the plated steel sheet for hot press use is blanked as required, then heated to a high temperature to make the plated steel sheet for hot press use soften. Further, the softened plated steel sheet for hot press use is press formed to shape it, then is cooled. By softening the plated steel sheet for hot press use once in this way, it is possible to easily perform the subsequent press forming. Further, the plated steel sheet for hot press use of the present invention can be hardened by heating and cooling and realize an approximately 1500 MPa or more high tensile strength.

As the heating method, in addition to the usual electrical furnace, a radiant tube furnace, infrared furnace, etc. may be employed.

The Al plated steel sheet melts if heated to the melting point or more and simultaneously diffuses with Fe whereby the Al phase changes to the Al—Fe alloy phase and Al—

Fe—Si alloy phase. The Al—Fe alloy phase and Al—Fe—Si alloy phase have high melting points of 1150° C. or so. The Al—Fe phase and Al—Fe—Si phase come in a plurality of types and if heated at a high temperature or heated for a long time, change to the higher Fe concentration alloy phase.

The surface state which is desirable for the final shaped product is a state alloyed up to the surface and a state where the concentration of Fe in the alloy phase is not that high. If unalloyed Al remains, only this portion rapidly corrodes, the coated corrosion resistance deteriorates, and blisters occur extremely easily, so this is not desirable. On the other hand, if the concentration of Fe in the alloy phase becomes too high, the alloy phase itself falls in corrosion resistance, the coated corrosion resistance deteriorates, and blisters easily occur. That is, the corrosion resistance of the alloy phase depends on the concentration of Al in the alloy phase. Therefore, to improve the coated corrosion resistance, the state of alloying is controlled by the amount of deposition of Al and the heating conditions.

In the present invention, the average temperature elevation rate in the temperature region from 50° C. to a temperature 10° C. lower than the maximum peak temperature is preferably made 10 to 300° C./sec. The average temperature elevation rate governs the productivity in press forming plated steel sheet for hot press use. If the average temperature elevation rate is less than 10° C./sec, softening of the steel sheet for hot press use requires time. On the other hand, if over 300° C., the softening is rapid, but the alloying of the plating layer becomes remarkable and causes powdering. The general average temperature elevation rate is, in the case of heating in the atmosphere, about 5° C./sec. An average temperature elevation rate of 100° C./sec or more can be achieved by ohmic heating or high frequency induction heating.

The plated steel sheet for hot press use of the present invention can realize a high average temperature elevation rate, so the productivity of the shaped product can be improved. Further, the average temperature elevation rate has an effect on the chemical composition and thickness of the Al—Fe alloy phase, so is one of the important factors in control of the quality in plated steel sheet for hot press use. In the case of the plated steel sheet for hot press use of the present invention, the temperature elevation rate can be raised to 300° C./sec, so a broader range of control of quality becomes possible.

Regarding the maximum peak temperature, due to the principle of the hot press method, heating is necessary in the austenite region, so usually a temperature of 900 to 950° C. or so is employed. In the hot press method of the present invention, the maximum peak temperature is not particularly limited, but if less than 850° C., sufficient quenching hardness is not obtained, so this is not preferable. Further, the Al plating layer has to be made an Al—Fe alloy phase. From this viewpoint, it is not preferable to make the maximum peak temperature less than 850° C. On the other hand, if the maximum peak temperature exceeds 1000° C., the alloying will proceed too far, the concentration of Fe in the Al—Fe alloy phases will rise, and a drop in the coated corrosion resistance will be invited. The upper limit of the maximum peak temperature cannot be defined across the board since it depends also on the temperature elevation rate and amount of deposition of Al, but even if considering economy, it is not preferable to make the maximum peak temperature is 1100° C. or more.

Advantageous Effects of Plated Steel Sheet for Hot Press Use and Hot Press Method of Present Invention The plated steel sheet for hot press use of the present invention has a surface coating layer which contains a compound which contains Zn, in particular which contains Zn hydroxide, so a high lubricity is realized and the chemical convertability is improved. Further, the plated steel sheet for hot press use of the present invention is resistant to peeling of the coating after shaping. As a result, adhesion of the Al—Fe intermetallic compounds to the die is prevented, the shapeability and productivity at the time of hot press forming are improved, and the chemical convertability after hot press forming is also improved. Furthermore, the steel sheet for hot press use of the present invention is excellent in adhesion of the Al plating layer and surface coating layer after shaping and also excellent in corrosion resistance of the shaped product, that is, the coated corrosion resistance.

The reason the chemically converted coating forms due to a Zn compound such as Zn hydroxide is unclear at the present stage, but the chemical conversion reaction proceeds while triggering an etching reaction by acid of the material. The surface of the Al—Fe intermetallic compound is extremely inert to acid, so it is guessed that the reaction has difficulty proceeding. A Zn compound is an amphoteric compound and dissolves in an acid, so is believed to react with a chemical conversion solution.

EXAMPLES

Next, examples will be shown while further explaining the present invention. Note that, the present invention is not limited to the examples which are shown below.

Example 1

A cold rolled steel sheet of the chemical composition which is shown in Table 1 (sheet thickness 1.4 mm) was used. This cold rolled steel sheet was plated with Al by the Sendzimir process. The annealing temperature was made about 800° C., the Al plating bath contained Si: 9%, and Fe which was eluted from the cold rolled steel sheet was contained. The amount of deposition of Al after plating was adjusted by the gas wiping method to 160 g/m$^2$ at both surfaces. After cooling, a suspension or aqueous solution which was shown in Table 2 was coated by a roll coater and was baked on at about 80° C. to produce a test material. Note that, each solution which is shown in Table 2 was obtained by using reagents and mixing them with distilled water to form a suspension or aqueous solution.

The characteristics of the thus produced test material were evaluated by the following methods. Note that, the average temperature elevation rate when heating to 900° C. was made 5° C./sec.

(1) Hot Lubricity

The apparatus which is shown in FIG. 1 was used to evaluate the hot lubricity. A 150×200 mm test material was heated to 900° C., then a steel ball was pushed against it from the top at 700° C. to measure the push-in load and pull-out load. The (pull-out load)/(push-in load) was made the dynamic coefficient of friction.

(2) Coating Adhesion

The test material was inserted into an atmosphere furnace, heated at 900° C. for 6 minutes, taken out, then immediately clamped in a stainless steel die and rapidly cooled. The cooling rate at this time was made 150° C./sec. Next, the test material was cut to 50×50 mm and used for a wrapping test. The method was to run gauze to which 2.0 kgf (1 kgf is 9.8N) of load was applied back and forth 10 times over a 30 mm length, measure the amount of deposition of Zn before and after the test, and calculate the amount of reduction %.

(3) Spot Weldability

The test material was inserted into an atmosphere furnace, heated at 900° C. for 6 minutes, taken out, then immediately clamped in a stainless steel die and rapidly cooled. The cooling rate at this time was made 150° C./sec. Next, the test material was cut to 30×50 mm and the range of suitable current for spot welding (difference of upper limit current and lower limit current) was measured. The measurement conditions were as follows: The lower limit current was made the current value when the nugget size $4t^{1/2}$ (t: sheet thickness) was 4.4 mm, while the upper limit current was made the dust generating current.

Electrode: made of chromium copper, DR type (tip size 6 mm, 40R radius shape)

Applied voltage: 400 kgf (1 kgf is 9.8N)

Electrification time: 12 cycles (60 Hz)

(4) Coated Corrosion Resistance

The test material was inserted into an atmosphere furnace, heated at 900° C. for 6 minutes, taken out, then immediately clamped in a stainless steel die and rapidly cooled. The cooling rate at this time was made 150° C./sec. Next, the test material was cut to 70× 150 mm and was chemically converted using a chemical conversion solution (PB-SX35) made by Japan Parkerizing, then was given an electrodeposition coating (Powernix 110) made by Nippon Paint and was baked at 170° C. to form a 20 μm coating.

The coated corrosion resistance was evaluated based on the JASO M609 of the Society of Automotive Engineers of Japan. The coating was cross-cut by a cutter in advance and the width of blisters from the cross-cuts after an 180 cycle (60 day) corrosion test (maximum value of one side) were measured. The reference material was a general corrosion-proof steel sheet comprised of hot dip galvannealed steel sheet with zinc deposited to 45 g/m$^2$ per surface. If the coated corrosion resistance is better than the reference material, use as corrosion-proof steel sheet is possible. Note that the width of the blisters of the reference material was 7 mm.

TABLE 1

| Chemical Composition of Test Material (mass %) | | | | | | | |
|---|---|---|---|---|---|---|---|
| C | Si | Mn | P | S | Ti | B | Al |
| 0.22 | 0.12 | 1.25 | 0.01 | 0.005 | 0.02 | 0.003 | 0.04 |

TABLE 3

| No. | Compound | Hot lubricity | Coating adhesion | Spot weldability | Coated corrosion resistance | Remarks |
|---|---|---|---|---|---|---|
| 1 | A | 0.74 | 8% | 2.1 kA | 1.8 mm | Inv. ex. |
| 2 | B | 0.74 | 9% | 2.2 kA | 2.2 mm | Inv. ex. |
| 3 | C | 0.75 | 7% | 2.0 kA | 2.3 mm | Inv. ex. |
| 4 | D | 0.76 | 5% | 2.2 kA | 2.1 mm | Inv. ex. |
| 5 | E | 0.79 | 9% | 2.0 kA | 2.4 mm | Inv. ex. |
| 6 | F | 0.75 | 25% | 2.0 kA | 2.0 mm | Comp. ex. |
| 7 | Untreated | 0.95 | — | 2.1 kA | 6.0 mm | Conv. ex. |
| 8 | A + 5% G | 0.76 | 9% | 2.0 kA | 2.2 mm | Inv. ex. |
| 9 | A + D | 0.73 | 10% | 2.2 kA | 2.1 mm | Inv. ex. |
| 10 | A + 5% H | 0.77 | 10% | 2.0 kA | 2.5 mm | Inv. ex. |
| 11 | G | 0.92 | 20% | 1.4 kA | 4.5 mm | Comp. ex. |
| 12 | H | 0.77 | 23% | 1.5 kA | 5.2 mm | Comp. ex. |
| 13 | A + 10% G | 0.77 | 11% | 1.9 kA | 2.4 mm | Inv. ex. |
| 14 | A + 10% G | 0.78 | 11% | 1.8 kA | 2.7 mm | Inv. ex. |
| 15 | A + 15% G | 0.81 | 14% | 0.9 kA | 3.5 mm | Comp. ex. |
| 16 | A + 15% H | 0.82 | 14% | 0.8 kA | 4.1 mm | Comp. ex. |

Note 1)
"A + D" indicates inclusion of A and D in equal amounts. The amount of deposition of the surface coating was made 1 g/m$^2$ by total amount of Zn.
Note 2)
"A + 5 to 15% G" indicates inclusion of G in 5 to 15% by mass % with respect to A. The amount of deposition of the surface coating was made 1 g/m$^2$ by total amount of Zn.
Note 3)
"A + 5 to 15% H" indicates inclusion of H in 5 to 15% by mass % with respect to A. The amount of deposition of the surface coating was made 1 g/m$^2$ by total amount of Zn.

The results of evaluation are shown in Table 3. The hot lubricity is shown by the measured dynamic coefficient of friction, the coating adhesion is shown by the amount of reduction of Zn % before and after heating, the spot weldability is shown by the suitable range of current, and the coated corrosion resistance is shown by the width of blisters. Note that, No. 7 was Al plated steel sheet as is without formation of a surface coating layer.

From Table 3, it was confirmed that by forming surface coating layers which contain Zn compounds of A to E, it is possible to improve the hot lubricity, coating adhesion, and coated corrosion resistance without causing the deterioration of the spot weldability.

Here, No. 6 is a comparative example where a treatment solution comprising a suspension of ZnO and a urethane-based binder mixed together is coated. While the hot lubricity and coated corrosion resistance were excellent, the coating adhesion was 25% or remarkably inferior compared with the invention examples.

Further, the comparative examples where surface coating layers which contain Zn compounds of G and H are formed (Nos. 11 and 12) were inferior in coating adhesion and spot weldability. This is because the treatment solutions which contain the compounds G and H are high in water solubility, easily run off when coated on Al plated steel sheet, and are inferior in deposition ability. However, as shown in Nos. 8 and 10, if the contents in the surface coating layers of G and

TABLE 2

| Compound | A | B | C | D | E | F | G | H |
|---|---|---|---|---|---|---|---|---|
| Coating treatment solution | $Zn(OH)_2$ Suspension | $Zn_3(PO_4)_2$ Suspension | $Zn(C_{17}H_{33}COO)_2$ Suspension | $Zn(CH_3COO)_2$ Aqueous solution | $C_{12}H_{22}O_{14}Zn \cdot 3H_2O$ Suspension | ZnO Suspension | $ZnSO_4$ Aqueous solution | $Zn(NO_3)_2$ Aqueous solution |
| Concentration (g/l) *1 | 200 | 200 | 200 | 200 | 200 | 200 | 200 | 200 |
| Zn deposition am't *2 | 1 g/m$^2$ | 1 g/m$^2$ | 1 g/m$^2$ | 1 g/m$^2$ | 1 g/m$^2$ | 1 g/m$^2$ | 1 g/m$^2$ | 1 g/m$^2$ |

*1 Inclusion, by mass %, of 20% of urethane resin with respect to Zn compounds in addition to Zn compounds.

*2 Amount when all Zn.

H are, by mass %, 10% or less, it was confirmed that the effect on deterioration of the coating adhesion and spot weldability was small.

Next, to what extent a surface coating which contains a Zn compound should be formed was determined by changing the amount of deposition of surface coating layer and evaluating the hot lubricity. The amount of deposition of the surface coating was evaluated by the amount of deposition of Zn in the surface coating. The treatment solution used was one which contained the Zn compound of A of Table 2. The results are shown in FIG. 2.

As clear from FIG. 2, it was confirmed that by an amount of deposition of Zn of 0.5 g/m$^2$ or more, more preferably 1 g/m$^2$ or more, the hot lubricity can be improved. The various values in FIG. 2 are shown in Table 4. As clear from Table 4, it was confirmed that by an amount of deposition of Zn of 2 g/m$^2$, the value of the coefficient of hot friction became saturated.

TABLE 4

Coefficient of Hot Friction

| Am't of deposition (g/m$^2$) | 0 | 0.4 | 0.7 | 1.1 | 1.5 | 2 | 2.4 | 2.9 | 5 | 7 |
|---|---|---|---|---|---|---|---|---|---|---|
| Coefficient of hot friction | 0.95 | 0.84 | 0.76 | 0.71 | 0.65 | 0.65 | 0.66 | 0.64 | 0.61 | 0.6 |

Example 2

A treatment solution was prepared by changing the ratio of addition (%) of a urethane resin to a suspension which contains the Zn compound of A of Table 2 with respect to the $Zn(OH)_2$. This was applied to the Al plated steel sheet of Example 1 to form a surface coating layer and prepare a test material. The baking conditions were the same as in Example 1. Further, the adhesion of this test material was evaluated. The methods of evaluation were the same as Example 1 except for the evaluations being performed before the heating. That is, the test material was cut to 50×50 mm and subjected to a wrapping test. The method was to run gauze to which 1.5 kgf (1 kgf is 9.8N) of load was applied back and forth 10 times over a 30 mm length, measure the amount of deposition of Zn before and after the test, and calculate the amount of reduction %.

TABLE 5

Table 5. Coating Adhesion Before Heating

| Resin ratio | 0% | 5% | 9% | 16% | 28% | 50% |
|---|---|---|---|---|---|---|
| Adhesion before heating | 20% | 5% | 1% | 0.2% | 0.2% | 0.2% |

The results are shown in Table 5. It could be confirmed that the adhesion before heating was improved by the addition of urethane resin. Further, it could be confirmed that even if adding urethane resin in 16% or more, the effect became saturated.

Example 3

A steel sheet for hot press use of the present invention which was formed using a treatment solution which contains the Zn compound of No. 1 in Example 1 was used. An infrared ray furnace was used to heat the steel sheet by an average heating rate of 30° C./second to evaluate the characteristics of the test material. The methods of evaluation were similar to the methods which were shown in Example 1 except for the heating method. The results of evaluation are shown in Table 6. The coated corrosion resistance was superior to the case of No. 1 as a result. It could be confirmed that the rapid heating method was effective.

TABLE 6

Results of Evaluation at Time of Application of Rapid Heating

| Compound | Hot lubricity | Coating adhesion | Spot weldability | Coated corrosion resistance |
|---|---|---|---|---|
| A | 0.75 | 7% | 2.0 kA | 0.9 mm |

Example 4

A cold rolled steel sheet of the chemical composition which is shown in Table 1 (sheet thickness 1.4 mm) was used. This cold rolled steel sheet was plated with Al by the Sendzimir process. The Al plating bath was changed in Si concentration to 3, 6, 9, 13, 15, 18, and 21%. In addition, it contained Fe which was eluted from the cold rolled steel sheet. The amount of deposition of Al after plating was adjusted by the gas wiping method to 160 g/m$^2$ at both surfaces. After cooling, a treatment solution which contained the Zn compound which was shown by A in Table 2 was coated by a roll coater and was baked on at about 80° C. to produce test materials. These test materials were evaluated for characteristics by methods similar to Example 1. Note that, the amount of deposition of Zn was in each case about 1 g/m$^2$. The results of evaluation are shown in Table 7. As clear from Table 7, it could be considered that when the Si concentration is 3 to 15%, the coated corrosion resistance is particularly excellent.

TABLE 7

| Si concentration (mass %) | Hot lubricity | Coating adhesion | Spot weldability | Coated corrosion resistance |
|---|---|---|---|---|
| 3 | 0.74 | 13% | 2.2 kA | 2.2 mm |
| 6 | 0.73 | 10% | 2.1 kA | 1.9 mm |
| 9 | 0.74 | 9% | 2.1 kA | 1.8 mm |
| 13 | 0.73 | 9% | 2.1 kA | 1.8 mm |
| 15 | 0.74 | 9% | 2.0 kA | 1.7 mm |
| 18 | 0.73 | 12% | 2.0 kA | 2.3 mm |
| 21 | 0.74 | 13% | 1.9 kA | 2.3 mm |

As explained above, while preferred embodiments of the present invention were explained in detail, the present invention is not limited to these embodiments. Any embodiments which are within the scope described in the claims shall be considered to be included in the present invention.

INDUSTRIAL APPLICABILITY

According to the present invention, when hot pressing the Al plated steel sheet, since the lubricity is good and the workability is improved, a more complicated shape of shaped product than the past can be press formed. Furthermore, labor can be saved in the maintenance and inspection of the hot press die and the productivity of the shaped product can be improved. The shaped product after hot press forming as well is good in chemical convertability, so the painting ability and corrosion resistance of the final shaped product can be improved as well. In this way, the present invention enables hot pressing of Al plated steel sheet to be expanded to the automobile industry etc. Therefore, the present invention is high in value of application in industry.

The invention claimed is:

1. A plated steel sheet for hot press use characterized by being a plated steel sheet for hot press use which contains a steel sheet, an Al plating layer which is formed on one surface or both surfaces of said steel sheet, and a surface coating layer which is formed on said Al plating layer, said surface coating layer consisting of one or more Zn compounds selected from the group consisting of Zn hydroxide and a Zn organic acid and optionally one or both of Zn sulfate and Zn nitrate, and one or more of a resin ingredient, silane coupling agent, or silica in a total ratio of 5 to 30% by mass with respect to a total amount of said one or more Zn compounds, wherein the optional one or both of Zn sulfate and Zn nitrate, as a content of said one or more Zn compounds, are contained in respectively 10 mass % or less, and an amount of deposition of the one or more Zn compounds in said surface coating layer is 0.5 to 7 $g/m^2$ per surface as Zn.

2. The plated steel sheet for hot press use according to claim 1 characterized in that said Al plating layer contains Si: 3 to 15%.

3. The plated steel sheet for hot press use according to claim 1, wherein the one or more Zn compounds comprise 10% or less, per mass %, of one or both of Zn sulfate and Zn nitrate.

4. The plated steel sheet for hot press use according to claim 2, wherein the one or more Zn compounds comprise 10% or less, per mass %, of one or both of Zn sulfate and Zn nitrate.

5. A method of hot pressing the plated steel sheet of claim 1, comprising: blanking said plated steel sheet; heating the plated steel sheet; and pressing said heated plated steel sheet.

6. The method of hot pressing according to claim 5 characterized in that in the heating before pressing, an average temperature elevation rate is 10 to 300° C./sec at a time when said plated steel sheet is heated by ohmic heating or induction heating from 50° C. to a temperature 10° C. lower than a maximum peak temperature.

* * * * *